United States Patent [19]

Hendriks

[11] 4,145,300

[45] Mar. 20, 1979

[54] DEVELOPERS CONTAINING MAGNETIC PARTICLES AND A SUBLIMABLE DYESTUFF

[75] Inventor: Dieter Hendriks, Geneva, Switzerland

[73] Assignee: Sublistatic Holding S.A., Glaris, Switzerland

[21] Appl. No.: 728,098

[22] Filed: Sep. 30, 1976

[30] Foreign Application Priority Data

Oct. 7, 1975 [CH] Switzerland ..... 13006/75

[51] Int. Cl.[2] ..... G03G 9/08; G03G 9/14

[52] U.S. Cl. ..... 252/62.1 P; 8/2.5 A; 96/1 SD; 96/1.2; 159/48 R; 252/62.53; 252/62.54; 427/18

[58] Field of Search ..... 252/62.1 P, 62.1 R, 252/62.53, 62.54; 8/2.5 A, 4; 96/1 SD, 1.2; 427/18; 159/48 R

[56] References Cited

U.S. PATENT DOCUMENTS

| | | | |
|---|---|---|---|
| 2,890,968 | 6/1959 | Giamo | 252/62.1 P |
| 3,052,564 | 9/1962 | Kulesza | 427/18 |
| 3,377,286 | 4/1968 | Stricklin | 252/62.1 P |
| 3,558,492 | 1/1971 | Proskaw | 252/62.1 P |
| 3,561,003 | 2/1971 | Lanham et al. | 159/48 R |
| 3,627,682 | 12/1971 | Hall et al. | 252/62.1 P |
| 3,679,612 | 7/1972 | Titow | 252/62.1 P |
| 3,900,318 | 8/1975 | Zographos et al. | 96/1.2 |
| 3,925,219 | 12/1975 | Strong | 252/62.1 P |
| 3,941,898 | 3/1976 | Sadamatsu et al. | 252/62.1 P |

FOREIGN PATENT DOCUMENTS

| | | | |
|---|---|---|---|
| 485353 | 5/1976 | Australia | 252/62.1 |
| 2452530 | 6/1975 | Fed. Rep. of Germany | 252/62.1 |
| 2253230 | 6/1975 | France | 252/62.1 |

OTHER PUBLICATIONS

*Chemical Abstracts*, vol. 84:97819u, Mehl et al., (1976).

*Primary Examiner*—John D. Smith

*Attorney, Agent, or Firm*—Sprung, Felfe, Horn, Lynch & Kramer

[57] ABSTRACT

Developers containing a polymer and at least one sublimable or vaporizable dyestuff which, at atmospheric pressure, passes into the vapor state at between 100° and 220° C., and characterized in that they consist of particles containing a mixture of at least one polymer with a plasticizer or a wax, which release the vapors of said dyestuff if heated at the sublimation or vaporization temperature of said dyestuff, and process for their preparation.

16 Claims, No Drawings

DEVELOPERS CONTAINING MAGNETIC PARTICLES AND A SUBLIMABLE DYESTUFF

The French Patent Application of the present applicant, published under No. 2,253,230, discloses develops constituted by an organic material, generally a polymer, which coats magnetic particles and contains a dyestuff which, at atmospheric pressure, passes into the vapour state at between 100° and 220° C. The developers thus consist of magnetic particles, for example iron particles, coated with a coating material chosen from among a great variety of categories of polymers; but the chbice was limited to those of the products which have a weak affinity for the dyestuffs which they contain, so that the said dyestuffs, under the action of heat, transfer easily from the developer to the surfaces with which they are kept in contact while a copy may be produced.

It has now been found that excellent results are obtained whatever affinity the polymers may have for the dyestuffs which they contain, provided a certain amount of a plasticiser or of a wax is added to the coating polymer composition.

Accordingly the present invention relates to developers containing a polymer and at least one sublimable or vaporisable dyestuff which, at atmospheric pressure, passes into the vapour state at between 100° and 220° C., and characterised in that they consist of particles containing a mixture of at least one polymer with a plasticiser or a wax, which release the vapors of said dyestuff if heated at the sublimation or vaporisation temperature of said dyestuff. The polymer particles may or may not contain magnetic particles.

These developers have also the advantage that they can easily be fixed to the substrate which receives the copy because they have improved rheological, in particular thermoplastic, properties. The addition of a plasticiser also has the advantage of broadening the range of developers placed at the disposal of the user, because it makes it possible to vary the resistivity of the developers in accordance with the substrate used to receive the copy.

The incorporation of the dyestuffs in the developers of the present invention, as well as the possible coating of the magnetic particles, can be carried out by any appropriate means, for example by thermodiffusion, selective coating or fluidised bed coating and above all by the spray drying technique.

The thermodiffusion of the dyestuff can be carried out under a pressure of at least five tons, at a temperature of about 70° C. ,or the resin or polymer can be dyed in a conventional dye bath corresponding to the dyestuff to be applied to it. The spray drying technique consists of drying —in a suitable stream of air —an organic solution or an organic dispersion containing the dyestuffs and the magnetic particles in suspension in a solution of the polymer in an organic solvent. Spherical powder particles are thus obtained.

In the event that magnetic particles are incorporated in the developers, all these means make it possible to vary at will the thickness of the polymer coating on these magnetic particles. It is however advantageous not to exceed a thickness of a few microns, a thickness of 2–10 microns already being sufficient to ensure the physical integrity of the coating and to provide an amount of material which is able to absorb sufficient dyestuff to give dark copies if necessary.

Using these processes, it proves easy to prepare the developers of the present invention; the polymer contains from 0.1 to 6% (by weight) of sublimable dyestuff; the diameter of the developer particles preferably varies between an average of 1 and 40 microns; in the event of magnetic developers, they can contain up to 60% by volume of polymer around the magnetic grains, the weight of polymer can be as much as 40% of the total weight of the particle.

It is particularly advantageous to add to the developers thus obtained an antistatic agent, which prevents the agglomeration of the particles, or various other adjuvants, especially products which maintain the good rheological properties of the developers, such as the colloidal forms of pyrogenic silicic acid which can attain a fineness of the order of half a micron or even less, or electrically conductive materials such as, for example, carbon black. The addition of a hydrophobic agent or an agent which increases the fluidity of the powder may also be mentioned.

Other adjuvants, such as emulsifiers or anti-foaming agents, can optionally be added to facilitate the preparation of the developers.

Amongst the plasticisers which can be used in accordance with the present invention, there may in particular be mentioned those which are compatible with an ethylcellulose coating, namely esters of phosphoric acid such as tributyl phosphate, methyl diphenyl phsophate, cresyl diphenyl phosphate, tri-(2-ethylhexyl) phosphate, triethyl phosphate or triphenyl phosphate, esters of phthalic acid, and various esters such as abietates, adipates, butyrates, hexanoates, glycolates or stearates, for example diisooctyl adipate, methyl abietate, butyl stearate, triethylene glycol di-(2-ethylbutyrate) or triethylene glycol di-(2-ethylhexanoate); there may also be mentioned amides, such as p-toluenesulphonamide, mineral oils, fatty acids, such as linseed oil, fatty alcohols, such as myristyl alcohol or stearyl alcohol, vegetable oils or plasticisers pf various kinds such as camphor, benzene hexachloride, β-(p-tert. -amyl or -butyl)-phenoxy-ethanol, phenol, phenylcellosolve and the like. The developers can contain between 0.5 and 30% of plasticiser, preferably at between 5 and 20%.

The waxes which can be used in accordance with the present invention can be of mineral, vegetable or animal origin and can be in the crude or refined state, they can also be synthetic.

They can be esters of fatty acids of high molecular weight and alcohols of high molecular weight, or long-chain paraffins and their derivatives (alcohols, halogenated derivatives, ketones, acids, ethers, and esters of cyclic or aliphatic alcohols), some obtained by a FISCHER-TROPSCH synthesis, or derivatives of polyethylenes or of polyolefines which have been polymerised with ZIEGLER-NATTA catalysts. They may be mixtures, optionally contain metal salts, silicone oils, polyethylene or polyisobutylene. All these products, though having different chemical structures, have similar rheological properties, namely they are thermoplastic, melt at a fairly low temperature, in general at about 80° or 65° C., and even 40° C. (myrtle wax) or 11° C. (jojoba wax), but, apart form a few exceptions, always below 90° C.; they have a low viscosity in the molten state, are not thread-pulling and contain virtually no compounds which leave an ash. They easily form pastes or gels. They can be malaxated at from 20° C. onwards. Furthermore they are opaque or translucent.

There may be mentioned beeswax, ozokerite, myrtle wax, wax from the Japanese wax tree, from the Chinese wax tree and from sugar cane, palm wax, carnauba wax, candellila wax, caranda wax, hydrogenated castor oil, certain mineral bitumens, such as esters of the acid $C_{27}H_{55}COOH$ with ceryl or myricyl alcohols (MONTAN WAX) mixtures of cetyl alcohol with octadecyl alcohol or stearyl alcohol (LANETTE WACHS), mixtures containing the palmitate of myricyl alcohol ($C_{15}H_{31}COO—C_{30}H_{61}$), cerotinic acid ($C_{25}H_{51}—COOH$) or melissic acid ($C_{29}H_{59}COOH$), the myricyl ester of cerotinic acid, or ceryl alcohol, or substances of the formula $C_{30}H_{68}O_3$ or $C_{32}H_{66}$, for example.

The polymers containing these waxes or plasticisers can be thermoplastics and can soften at between 100° and 160°C.; they have a particular interest for the developers of the present invention when they are capable of forming a film and are soluble in an organic medium or readily dispersible in water.

They can be chosen from among the polymers of a great diversity of categories, namely polysaccharide ethers and esters, such as cellulose esters, particularly cellulose acetate or acetobutyrate, and especially such as cellulose ethers, for example benzylcellulose, hydroxyethylcellulose, hydroxybutylcellulose, hydroxypropylcellulose, 2,3-dihydroxypropylcellulose or particularly ethylcellulose, polyesters, polyamides, polyolefines, epoxy resins, vinyl resins, acylic resins and polystyrenes.

They can also be mixtures of thermoplastic resins with other types of resins, for example brittle resins such as modified phenolformaldehyde resins or modified maleic anhydride-polyhydric alcohol resins, or esterified diphenol resins, or copolymers. The latter can be block copolymers or graft copolymers and can optionally consist of a mixture of crystalline and amorphous segments.

Materials to be mentioned are the polystyrenes, the copolymers of styrene or styrene homologue with alkylmethacrylates or alkylacrylates, the phenol formaldehyd resins, optionally modified by colophonium, the epoxy resins, the polyethylenes, the polyvinylchlorids, the alkyd resins modified by colophonium and mixtures thereof such as the mixture of polystyrene with polybutadiene, of acrylic polymers with polyvinylacetate, of polyurethanes with vinyl polymers as well as mixtures of polyamides with polyolefines.

Examples which may be mentioned among the polyesters are those obtained by reaction of polyglycidyl ethers of a polyhydric phenol with monocarboxylic or dicarboxylic fatty acids, or the polyesters obtained by reaction of dicarboxylic acids with polyols such as, for example, 2-methylpropane-1,3-diol, or with glycols.

Examples which are to be mentioned among the polyamides are mixtures containing aromatic polyamides possessing benzoxazole, benzothiazole or benzimidazole nuclei, polyamides prepared from polymerised fatty acids and ethylenediamine, polyalcohols and hydroxyamides. Materials which can be mentioned also are the polyaddition products of diisocyanates, primary and/or secondary alcohols and formaldehyde hemiacetals, the polymers of $\alpha,\beta$-unsaturated ethylenic products, the poly(p-xylylenes).

As examples of copolymers, following compounds can be mentioned: copolymers of an unsaturated carboxylic acid or of a glycidyl compound with an ethylenically unsaturated compound, or copolymers of polybutadienes, possessing terminal ureylene, carboimino or urethane groups, with a vinyl monomer, or the copolymers obtained form esters of unsaturated fatty acids and maleic anhydride mixed with a polybutadiene oil, or the products of the copolymerisation of an unsaturated ester of low molecular weight with one or more ethylenically unsaturated monomers having a $C_6$ to $C_{20}$ aliphatic chain.

The following terpolymers can be cited as examples: the vinyl acid/hydroxyalkyl acrylate or methacrylate/vinyl monomer or acrylic acid/vinylidene chloride/acrylonitrile terpolymers, or the copolymers of a vinyl ester, ethylene and an acrylamide. Or the olefine/acrylate copolymers, or the copolyers of alkyl esters and hydroxylalkyl esters of acrylic acid and of methacrylic acid, or the copolymers of styrene and indene containing acrylonitrile units.

Further materials to be mentioned are the copolymers of N-vinylcarbazole with a trialkoxyvinylsilane or a triacetoxy vinylsilane, optionally containing units of styrene or of an alkyl acrylate or alkyl methacrylate, the copolymers obtained by grafting at least one ethylenically unsaturated monomer onto an alkyd resin or obtained by reacting a phenol or an ethylenically unsaturated compound with a polydiolefine (such as polydicyclopentadiene, polybutadiene or other homopolymers of C—C dienes), or with a copolymer of butadiene or of a cycloaliphatic dienen and isoprene or butadiene; the reaction products of a higher fatty monoacid with a prepolymer of cyclopentadiene, of dicyclopentadiene substituded by an alkyle, an unsaturated alcohol or an ester of an unsaturated alcohol and an organic acid; the reaction products of one or more epoxide resins, which are optionally partially etherified with fatty acids, with one or more compounds obtained from dienes and unsaturated carboxylic or dicarboxylic acids or anhydrides, the intimate mixtures of polyvinyl acetate and a compatible epoxy resin or an acrylic polymer with cellulose acetobutyrate and alkylated melamine/formaldehyde resin or a triglycidyl isocyanurate. The resin-plasticiser or resin-wax mixture can contain up to 85% by weight of wax or up to 30% of plasticiser. The plasticiser is preferably soluble in the organic solvents.

The dyestuffs which pass into the vapour state at between 100° and 220° C. and which can be incorporated into the developers according to the invention can be chosen from the category of the so called basic dyestuffs (cationic dyestuffs) or from the category of the disperse dyestuffs and even from the category of the dyestuffs which are soluble in organic solvents and are classified under the heading "Solvent Dyes" in the COLOUR INDEX edited by THE SOCIETY OF DYERS AND COLOURISTS, Dean House, Picadilly, Bradford, Yorkshire, England, or from the category of the pigments.

They can also be azo dyestuffs, anthraquinone dyestuffs, quinophthalone derivatives, styryl derivatives, deiphenylmethanes and triphenylmethanes, oxazine or thiazine derivatives, xanthene derivatives, methines and azomethines, derivatives of acridine and of diazine and the like.

Apart from hydroxyquinophthalone it can be advantageous to use those of the dyestuffs indicated below, in particular from among the anthraquinone dyestuffs, which contain at least two substituents which are preferably different from one another. Thus, three developers which make it possible to produce colour copies are obtained by using hydroxyquinophthalone as the yellow dyestuff, 1-amino-2-phenoxy-4-hydroxyanthraquinone as the red dyestuff and 1,4-dihydroxy-5-amino-8-isopropylaminoanthraquinone as the blue dyestuff and preparing three separate developers with the aid of these dyestuffs.

It is advantageous to incorporate more than 2%, especially between 2.5 and 25% of dyestuff into the developers of the present invention. Generally, however, they contain less than 10%, preferably even less than 5% of dyestuff.

More particularly, the following may be mentioned; 1,4-dimethylaminoanthraquinone, brominated or chlorinated 1,5-dihydroxy-4,8-diaminoanthraquinone, 1,4-diamino-2,3-dichloroanthraquinone, 1-amino-4-hydroxyanthraquinone, 1-amino-4-hydroxy-2-phenoxyanthraquinone, the methyl, ethyl, butyl or propyl ester of 1,4-diaminoanthraquinone-2-carboxylic acid, 1-amino-4-anilido-anthraquinone, 1-amino-2-cyano-4-anilido- or -cyclohexyl-aminoanthraquinone, 1-hydroxy-2-(p-acetaminophenylazo)-4-methyl-benzene, 3-methyl-4-(nitrophenylazo)-pyrazolone, -(nitro-phenylazo)-acetoacetylanilide, 3'-hydroxyquinophthalone and, finally, the basic dyestuffs such as malachite green, methyl violet and the following dyestuffs (after modification with, for example, sodium acetate, sodium ethylate, sodium hydroxide or sodium methylate); No. 42,025, 42,037, 42,140, 45,006, 46,025, 48,013, 48,020, 48,035, 50,045, 51,005 and 52,010 of the Colour Index edited by "THE SOCIETY OF DYERS AND COLOURISTS" and "THE AMERICAN ASSOCIATION OF TEXTILE CHEMISTS AND COLORISTS" (second edition, 1956).

The following dyestuffs may be mentioned without this list implying a limitation:

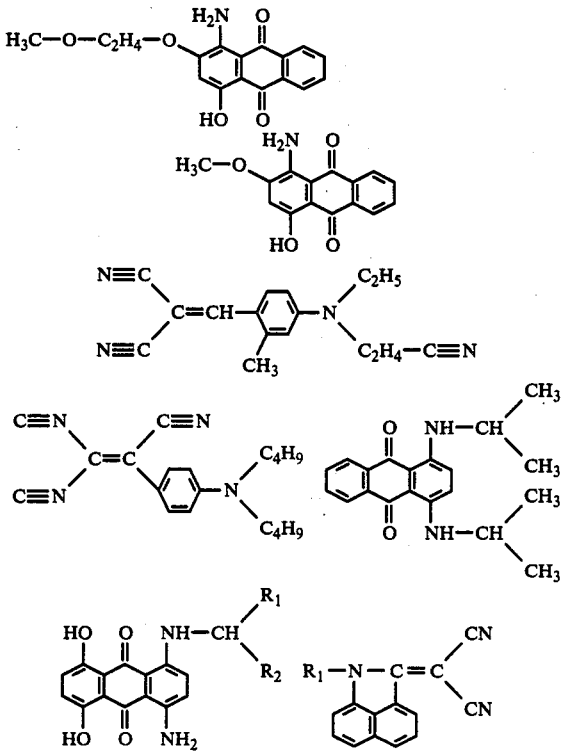

where $R_1$ and $R_2$ independently of one another represent an alkyl group with 1 to 3 carbon atoms, -continued

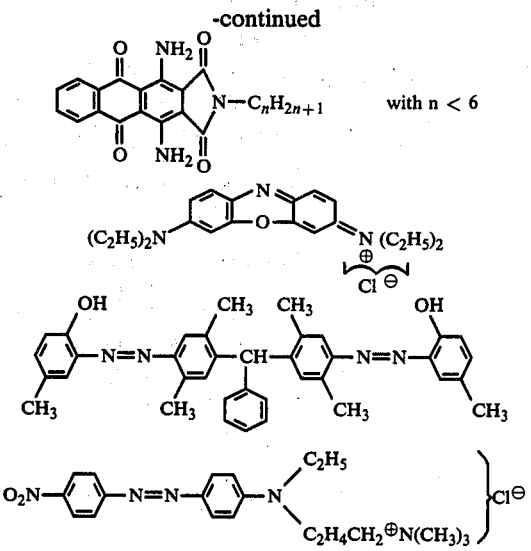

with n < 6

The magnetic particles which can be present in the developer particles of the present invention preferably consist of a ferromagnetic material, for example iron or magnetic alloys and oxides of iron, cobalt, nickel and manganese, for example. $Fe_3O_4$ or iron sesquioxide, barium ferrite, nickel-zinc ferrites, chromium oxide, nickel oxide and the like may be mentioned as specific examples. Their size is of the order of a few microns.

The pulverulent resin compositions of the invention are preferably used in electrophotography as a developing agent, in particular as a powder developer which can be fixed by pressure. But they can also be incorporated into coating compositions, paints, inks and the like.

The non-limiting examples which follow illustrate the present invention. In these examples, the parts and percentages are, unless stated otherwise, to be understood as being by weight and the temperatures as being in ° C.

EXAMPLE 1

A paste is formed by mixing 5 parts of a mixture containing 3.75 parts of ethylcellulose N7 and 1.25 parts of dibutyl phthalate, 2.5 parts of a preparation containing 50% of ethylcellulose and 50% of a yellow dyestuff of the formula

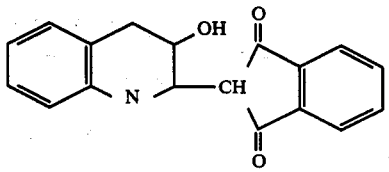

and 28 parts of a mixture of 50% of isopropanol and 50% of methylethyl ketone.

16.25 Parts of magnetic iron oxyde and 1.25 parts of carbon black are then dispersed in this paste, which is diluted with 47 parts of the mixture of solvents mentioned above.

This dispersion is then pumped into a turbine-type spray dryer. It is introduced into the spray dryer at 50° C. and the dry product issues therefrom at about 25° C.

A black powder is thus obtained which flows freely and of which the particles have a size of between 5 and 40 μ. 0.2% of SiO is added and the particles are classified, only retaining those of which the diameter varies between 10 and 35μ. This powder makes it possible to obtain very good results in the development of latent electrostatic images and in particular permits better fixing of the developed image than with the known toners. The final copies obtained by sublimation of the dyestuff are yellow copies having good properties.

EXAMPLE 2

30 Parts of magnetic iron oxyde are dispersed in 15 parts of water with the aid of 0.6 part of a dispersing agent, 0.25 part of ammoniac and 0.15 part of an anti-foaming agent. A homogeneous paste is obtained.

10 parts of a 25% strength aqueous dispersion of carbone black and 5 parts of a 50% aqueous dispersion of the red dyestuff of the formula

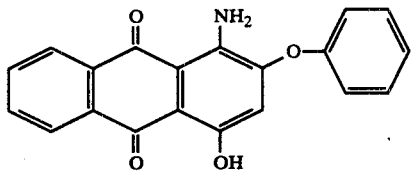

are then added, whilst stirring.

Thereafter, 22.5 parts of a 50% strength aqueous dispersion of polystyrene and 9.4 parts of a 40% strength aqueous dispersion of a natural wax (montan wax) of which the softening point is 80° C. are added. The mixture is diluted with 7.35 parts of water.

This dispersion is then pumped into a turbine-type spray dryer. It is introduced into the spray dryer at 250° C.and the temperature at the outlet of the spray dryer is 80° C.

A black powder is thus obtained which flows freely and in which the size of the particles is between 5 and 40 μ. 0,2% of $SiO_2$ is added and the particles are classified, only retaining those of which the diameter varies between 10 and 35μ. This powder makes it possible to obtain as good results as those obtained in Example 1.

The image obtained by sublimation of the dyestuff from the developed and fixed powder image is a faithful red copy of the original.

EXAMPLE 3

The same procedure as in Example 2 can be followed, but using 32.5 parts of magnetic iron oxyde in place of 30 parts, 10 parts of a 50% strength aqueous dispersion of the blue dyestuff of the formula

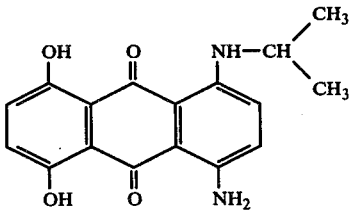

3 parts of a 50% strength aqueous dispersion of an acrylic resin of which the softening point is of the order of 110° C. and 21.25 parts of a 40% strength aqueous dispersion of a natural wax of which the softening point is 75° C. The mixture is diluted with 7.5 parts of water.

A black powder is obtained, which gives results as satisfactory as those obtained in Example 2. The final copies obtained are no longer red but blue.

I claim:

1. A developer in the form of a dry free-flowing powder containing magnetic particles embedded in a mixture of a polymer and between 2.5 and 25% of at least one sublimable or vaporisable dyestuff which, at atmospheric pressure, passes into the vapour state at between 100° and 200° C., and consisting of particles containing particles of magnetic material in a mixture of at least one polymer with a wax, which release the vapors of said dyestuff if heated at the sublimation or vaporisation temperature of said dyestuff.

2. A developer according to claim 1, characterised in that at least one polymer contained in the particles exhibits affinity for the sublimable or vaporisable dyestuff.

3. A developer according to claim 2, characterised in that the polymer exhibiting affinity for the sublimable or vaporisable dyestuff is a member selected from the group consisting of a polyester, a polyamide, an epoxy resin, an etherified polysaccharide, an acrylic resin, a polyolefine, a copolymer carrying units corresponding to these homopolymers and a mixture of polymers containing one of these polymers or copolymers.

4. A developer according to claim 3, characterised in that the polymer exhibiting a dyestuff affinity is a cellulose ether.

5. A developer according to claim 3, characterised in that the polymer exhibiting a dyestuff affinity is ethylcellulose.

6. A developer according to claim 1, characterised in that the magnetic material consists of iron or iron oxide granules.

7. A developer according to claim 1, characterised in that the polymer exhibiting a dyestuff affinity is a polystyrene.

8. A developer according to claim 1, characterised in that the mixture of at least one polymer with a wax contains at least 5% and at most 85% of wax.

9. A developer according to claim 1, characterised in that they contain a montan wax.

10. A developer according to claim 1, characterised in that they contain an ester of the acid $C_{27}H_{55}COOH$ with ceryl alcohol or myricyl alcohol.

11. A developer according to claim 1, characterised in that they contain at least one sublimable cationic dyestuff or disperse dyestuff.

12. A developer according to claim 1, characterised in that they contain at least one hydroxyquinophthalone or a dyestuff containing at least two substituents which are different from one another.

13. A developer according to claim 14, characterised in that they contain at least one of the following dyestuffs: 3'-hydroxyquinophthalone or 1-amino-4-hydroxy-2-(-methoxy)-ethoxy-anthraquinone.

14. A developer according to claim 1, characterised in that they contain very fine silicon oxide powder.

15. A developer according to claim 1, characterised in that they contain carbon black powder.

16. A developer according to claim 1, characterised in that they contain an antistatic agent.

* * * * *

UNITED STATES PATENT AND TRADEMARK OFFICE

CERTIFICATE OF CORRECTION

PATENT NO. : 4,145,300

DATED : March 20, 1979

INVENTOR(S) : Hendriks

It is certified that error appears in the above-identified patent and that said Letters Patent are hereby corrected as shown below:

Column 8, line 12, delete "200°" and substitute --220°C--.

Column 8, line 55, delete "14" and substitute --11--.

Column 6, line 50 the formula should read as follows:

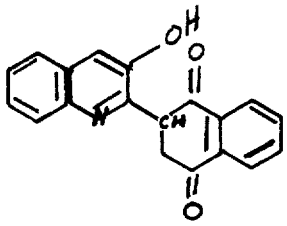

Signed and Sealed this

Thirteenth Day of November 1979

[SEAL]

Attest:

RUTH C. MASON
*Attesting Officer*

LUTRELLE F. PARKER
*Acting Commissioner of Patents and Trademarks*